US008839849B2

(12) United States Patent
Guest et al.

(10) Patent No.: US 8,839,849 B2
(45) Date of Patent: Sep. 23, 2014

(54) WATER SENSITIVE VARIABLE COUNTERWEIGHT DEVICE DRIVEN BY OSMOSIS

(75) Inventors: Randall V. Guest, Spring, TX (US); Stephen L. Crow, Kingwood, TX (US); Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 1 day.

(21) Appl. No.: 12/050,583

(22) Filed: Mar. 18, 2008

(65) Prior Publication Data

US 2009/0236102 A1 Sep. 24, 2009

(51) Int. Cl.

| | |
|---|---|
| ***E21B 33/12*** | (2006.01) |
| ***E21B 33/124*** | (2006.01) |
| ***E21B 43/32*** | (2006.01) |
| ***E21B 43/08*** | (2006.01) |
| ***E21B 34/08*** | (2006.01) |
| ***E21B 43/12*** | (2006.01) |
| ***E21B 43/14*** | (2006.01) |

(52) U.S. Cl.

CPC ..... *E21B 43/12* (2013.01); *E21B 33/124* (2013.01); *E21B 43/32* (2013.01); *E21B 43/08* (2013.01); *E21B 34/08* (2013.01); *E21B 43/14* (2013.01)

USPC ..... 166/54; 166/319; 166/332.8; 166/373; 166/386

(58) Field of Classification Search

CPC ..... E21B 33/124; E21B 34/08; E21B 43/08; E21B 43/12; E21B 43/14; E21B 43/32

USPC ..... 166/54, 319, 386, 373, 316, 227; 137/401, 403, 404

See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |

(Continued)

FOREIGN PATENT DOCUMENTS

| | | |
|---|---|---|
| CN | 1385594 | 12/2002 |
| GB | 1492345 | 11/1977 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — James Sayre

(74) *Attorney, Agent, or Firm* — Mossman, Kumar & Tyler PC

(57) ABSTRACT

A method for producing fluid from a subterranean formation includes configuring a body to at least partially fill with a selected fluid; and actuating a flow restriction element using the body. The selected fluid may be water. An apparatus for controlling flow of a fluid into a wellbore tubular may include a selectively buoyant body, and a flow restriction element responsive to a movement of the selectively buoyant body. The selectively buoyant body includes a membrane configured to block a flow of hydrocarbons into the selectively buoyant body. The flow restriction element may include a flapper, a sliding sleeve, and a poppet valve. The body may be at least partially filled with a permeable material, which includes, but is not limited to, open-cell foam, reticulated metal foam, shaped sintered powder and capillary tubes.

19 Claims, 5 Drawing Sheets

(56) References Cited

U.S. PATENT DOCUMENTS 1,915,867 A 6/1933 Penick
1,984,741 A 12/1934 Harrington
2,089,477 A 8/1937 Halbert
2,119,563 A 6/1938 Wells
2,214,064 A 9/1940 Niles
2,257,523 A 9/1941 Combs
2,412,841 A 12/1946 Spangler
2,762,437 A 9/1956 Egan et al.
2,810,352 A 10/1957 Tumilson
2,814,947 A 12/1957 Stegemeier et al.
2,942,668 A 6/1960 Maly et al.
2,945,541 A 7/1960 Maly et al.
3,326,291 A 6/1967 Zandmer
3,385,367 A 5/1968 Kollsman
3,419,089 A 12/1968 Venghiattis et al.
3,451,477 A 6/1969 Kelley
3,675,714 A 7/1972 Thompson
3,692,064 A 9/1972 Hohnerlein et al.
3,739,845 A 6/1973 Berry et al.
3,741,301 A 6/1973 Maly et al.
3,791,444 A * 2/1974 Hickey ..... 166/54
3,876,471 A 4/1975 Jones
3,918,523 A 11/1975 Stuber
3,951,338 A 4/1976 Genna
3,975,651 A 8/1976 Griffiths
4,153,757 A 5/1979 Clark
4,173,255 A 11/1979 Kramer
4,180,132 A 12/1979 Young
4,186,100 A 1/1980 Mott
4,187,909 A 2/1980 Erbsoesser
4,248,302 A 2/1981 Churchman
4,250,907 A * 2/1981 Struckman et al. ..... 137/1
4,257,650 A 3/1981 Allen
4,287,952 A 9/1981 Erbstoesser
4,294,313 A 10/1981 Schwegman
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,782,896 A 11/1988 Witten
4,821,800 A 4/1989 Scott et al.
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,033,551 A 7/1991 Grantom
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,829,522 A 11/1998 Ross et al.
5,831,156 A 11/1998 Mullins
5,839,508 A 11/1998 Tubel et al.
5,865,254 A 2/1999 Huber et al.
5,873,410 A 2/1999 Iato et al.
5,881,809 A 3/1999 Gillespie et al.
5,896,928 A 4/1999 Coon
5,982,801 A 11/1999 Deak
6,068,015 A 5/2000 Pringle
6,098,020 A 8/2000 Den Boer
6,109,350 A 8/2000 Nguyen et al.
6,112,815 A 9/2000 Boe et al.
6,112,817 A 9/2000 Voll
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,338,363 B1 1/2002 Chen et al.
6,367,547 B1 4/2002 Towers et al.
6,371,210 B1 * 4/2002 Bode et al. ..... 166/370
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnarson et al.
6,554,066 B2 * 4/2003 Lopes et al. ..... 166/265
6,581,681 B1 6/2003 Zimmerman et al.
6,581,682 B1 6/2003 Parent et al.
6,622,794 B2 9/2003 Zisk
6,632,527 B1 10/2003 McDaniel et al.
6,635,732 B2 10/2003 Mentak
6,667,029 B2 12/2003 Zhong et al.
6,672,385 B2 1/2004 Kilaas et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 * 11/2004 Wilson et al. ..... 166/332.1
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,004,248 B2 2/2006 Hoffman et al.
7,011,076 B1 3/2006 Weldon et al.
7,084,094 B2 8/2006 Gunn et al.
7,159,656 B2 1/2007 Eoff et al.
7,185,706 B2 * 3/2007 Freyer ..... 166/369
7,290,606 B2 11/2007 Coronado et al.
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 * 8/2008 Henriksen et al. ..... 166/373
7,413,022 B2 8/2008 Broome et al.
7,419,002 B2 9/2008 Dybevik et al.
7,426,962 B2 9/2008 Moen et al.
7,469,743 B2 12/2008 Richards
7,493,947 B2 2/2009 Ross
7,673,678 B2 3/2010 MacDougall et al.
7,762,341 B2 7/2010 Hammer
7,896,028 B2 3/2011 Weyer et al.
7,913,765 B2 3/2011 Crow et al.
7,942,206 B2 5/2011 Huang et al.
2002/0020527 A1 2/2002 Kilaas et al.
2002/0125009 A1 9/2002 Wetzel et al.
2003/0221834 A1 12/2003 Hess et al.
2004/0035578 A1 2/2004 Ross et al.
2004/0052689 A1 3/2004 Yao
2004/0108107 A1 6/2004 Wittrisch
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.

(56) References Cited

U.S. PATENT DOCUMENTS

| | | | | |
|---|---|---|---|---|
| 2006/0012439 | A1 | 1/2006 | Thomsen et al. | |
| 2006/0048936 | A1 | 3/2006 | Fripp et al. | |
| 2006/0048942 | A1 | 3/2006 | Moen et al. | |
| 2006/0076150 | A1* | 4/2006 | Coronado et al. | 166/386 |
| 2006/0086498 | A1 | 4/2006 | Wetzel et al. | |
| 2006/0108114 | A1 | 5/2006 | Johnson | |
| 2006/0118296 | A1 | 6/2006 | Dybevik et al. | |
| 2006/0175065 | A1 | 8/2006 | Ross | |
| 2006/0180320 | A1 | 8/2006 | Hilsman et al. | |
| 2006/0185849 | A1 | 8/2006 | Edwards et al. | |
| 2006/0266524 | A1 | 11/2006 | Dybevik | |
| 2006/0272814 | A1 | 12/2006 | Broome et al. | |
| 2006/0273876 | A1 | 12/2006 | Pachla | |
| 2007/0012444 | A1 | 1/2007 | Horgan et al. | |
| 2007/0034385 | A1 | 2/2007 | Tips et al. | |
| 2007/0039732 | A1 | 2/2007 | Dawson et al. | |
| 2007/0039741 | A1 | 2/2007 | Hailey | |
| 2007/0044962 | A1 | 3/2007 | Tibbles | |
| 2007/0131434 | A1 | 6/2007 | MacDougall et al. | |
| 2007/0246210 | A1 | 10/2007 | Richards | |
| 2007/0246213 | A1 | 10/2007 | Hailey | |
| 2007/0246225 | A1 | 10/2007 | Hailey, Jr. et al. | |
| 2007/0246407 | A1 | 10/2007 | Richards et al. | |
| 2007/0272408 | A1 | 11/2007 | Zazovsky et al. | |
| 2008/0035349 | A1 | 2/2008 | Bennett | |
| 2008/0035350 | A1 | 2/2008 | Henriksen et al. | |
| 2008/0053662 | A1 | 3/2008 | Williamson et al. | |
| 2008/0061510 | A1 | 3/2008 | Li et al. | |
| 2008/0110614 | A1 | 5/2008 | Orban | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0236839 | A1 | 10/2008 | Oddie | |
| 2008/0236843 | A1* | 10/2008 | Scott et al. | 166/386 |
| 2008/0283238 | A1* | 11/2008 | Richards et al. | 166/228 |
| 2008/0296023 | A1 | 12/2008 | Willauer | |
| 2008/0314590 | A1 | 12/2008 | Patel | |
| 2009/0056816 | A1 | 3/2009 | Arov et al. | |
| 2009/0101353 | A1* | 4/2009 | Crow et al. | 166/373 |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 | 8/2009 | Garcia et al. | |
| 2009/0283275 | A1 | 11/2009 | Hammer | |
| 2010/0038086 | A1 | 2/2010 | Bunnell | |
| 2010/0096140 | A1 | 4/2010 | Mack | |

FOREIGN PATENT DOCUMENTS

| | | | |
|---|---|---|---|
| GB | 2341405 | | 12/2007 |
| JP | 59089383 | B2 | 5/1984 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004018833 | A1 | 3/2004 |
| WO | WO 2006/015277 | | 7/2005 |
| WO | WO 2008/070674 | A1 | 6/2008 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Pressure Drop in Horizontal Wells and Its Effect on Production Performance; Dikken, Ben J.; SPE 19824, pp. 561-574, 1989; Koninklijke/ Shell E & P Laboratorium.

Restarick, Henry, Halliburton Energy Services, SPE Member; SPE 29831 Horizontal Completion Options in Reservoirs With Sand Problems; Presented at the SPE Middle East Oil Show, Behrain, Mar. 11-14, 1995; Copyright 1995, Society of Petroleum Engineers, Inc.

Dikken, Ben J., SPE, Konninkijke/Shell E&P Laboratorium; Pressure Drop in Horizontal Well and Its Effect on Production Performance; Nov. 1990, JPT, Copyright 1990 Society of Petroleum Engineers; pp. 1426-1433.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer", Xue, W., Champ, S. amd Huglin, M. B. 2001. European Polymer Journal, 37(5) 869-875.

Dinarvand, R., D'Emanuele, A (1995) The use of thermoresponsive hydrogels for on-off release of molecules, J. Control. Rel. 36: 221-227.

Tanaka, T., Nishio, I., Sun, S.T., Ueno-Nisho, S, (1982) Collapse of gels in an electric field, Science. 218:467-469.

Ishihara,K., Hamada, N., Sato, S., Shinohara, I., (1984) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules, 17: 2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard. Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining. Metallurgical and Petroleum Engineers, Inc.

* cited by examiner

WATER SENSITIVE VARIABLE COUNTERWEIGHT DEVICE DRIVEN BY OSMOSIS

CROSS-REFERENCE TO RELATED APPLICATIONS none

BACKGROUND OF THE INVENTION

1. Field of the Invention

The invention relates generally to systems and methods for selective control of fluid flow into a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides a method for producing fluid from a subterranean formation. In one arrangement, the method includes configuring a body to at least partially fill with a selected fluid; and actuating a flow restriction element using the body. The selected fluid may be water. In aspects, the method may include controlling an entry of fluid into the body using a membrane. In aspects, the membrane may be configured to block a flow of hydrocarbons into the body. In aspects, the method may also include venting a fluid from the body as the body fills with the selected fluid. In further aspects, the method may include controlling a flow of fluid into a passage in communication with a flow bore; and applying a force to the flow restriction element using the body as the body fills with the selected fluid. The force may urge the flow restriction element into a sealing engagement with the passage. The flow restriction element may include an open position wherein the flow restriction element is disengaged from the passage and a closed position wherein the flow restriction element at least partially blocks the passage. The flow bore may be a bore of a wellbore tubular. In aspects, the method may include maintaining the flow restriction element in the open position while the body is substantially not filled with water, and shifting the flow restriction element to the closed position after the body substantially fills with water.

In aspects, the present disclosure provides an apparatus for controlling flow of a fluid into a wellbore tubular. In one embodiment, the apparatus may include a selectively buoyant body configured to fill with a selected fluid, and a flow restriction element responsive to a movement of the selectively buoyant body. In aspects, the selectively buoyant body includes a membrane configured to block a flow of hydrocarbons into the selectively buoyant body. The selected fluid may include water. The selectively buoyant body may be coupled to the flow restriction element. In aspects, the flow restriction element may include, but not be limited to, a flapper, a sliding sleeve, and a poppet valve. In aspects, the interior of the body may be at least partially filled with a permeable material, which includes, but is not limited to, open-cell foam, reticulated metal foam, shaped sintered powder and capillary tubes.

In aspects, the present disclosure provides a system for controlling a flow of a fluid in a well intersecting a formation of interest. The system may include a tubular configured to be disposed in the well; a flow restriction element positioned at a selected location along the tubular, the flow restriction element being configured to control flow between a bore of the tubular and the exterior of the tubular; and an actuator coupled to the flow restriction element. The actuator may include a selectively buoyant body that has an interior space and a membrane controlling fluid communication into the interior space. In aspects, a valve may be used to vent the interior space. In embodiments, the system may include a plurality of flow restriction elements positioned at selected locations along the tubular. Each flow restriction element may be configured to control flow between a bore of the tubular and the exterior of the tubular. An actuator coupled to each flow restriction element may include a selectively buoyant body having an interior space and a membrane controlling fluid communication into the interior space.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
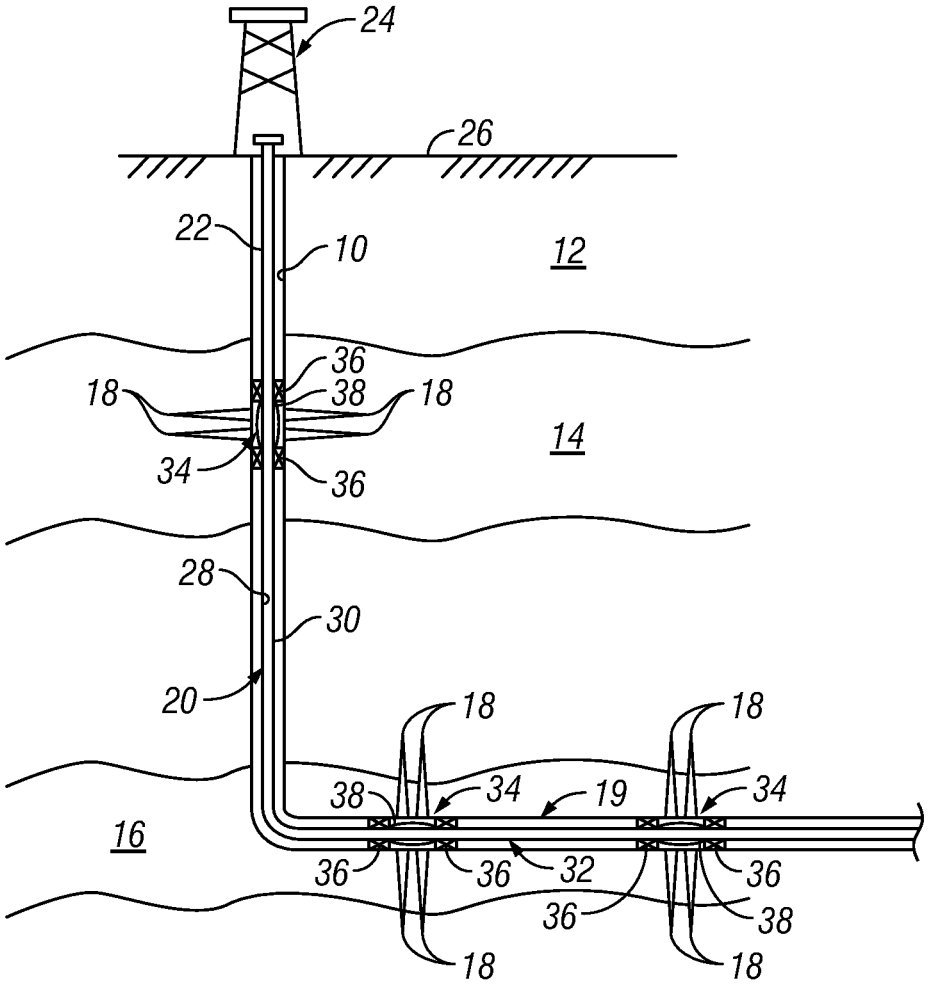
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Although only two production nipples 34 are shown in FIG. 1, there may, in fact, be a large number of such nipples arranged in serial fashion along the horizontal portion 32.

Each production nipple 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
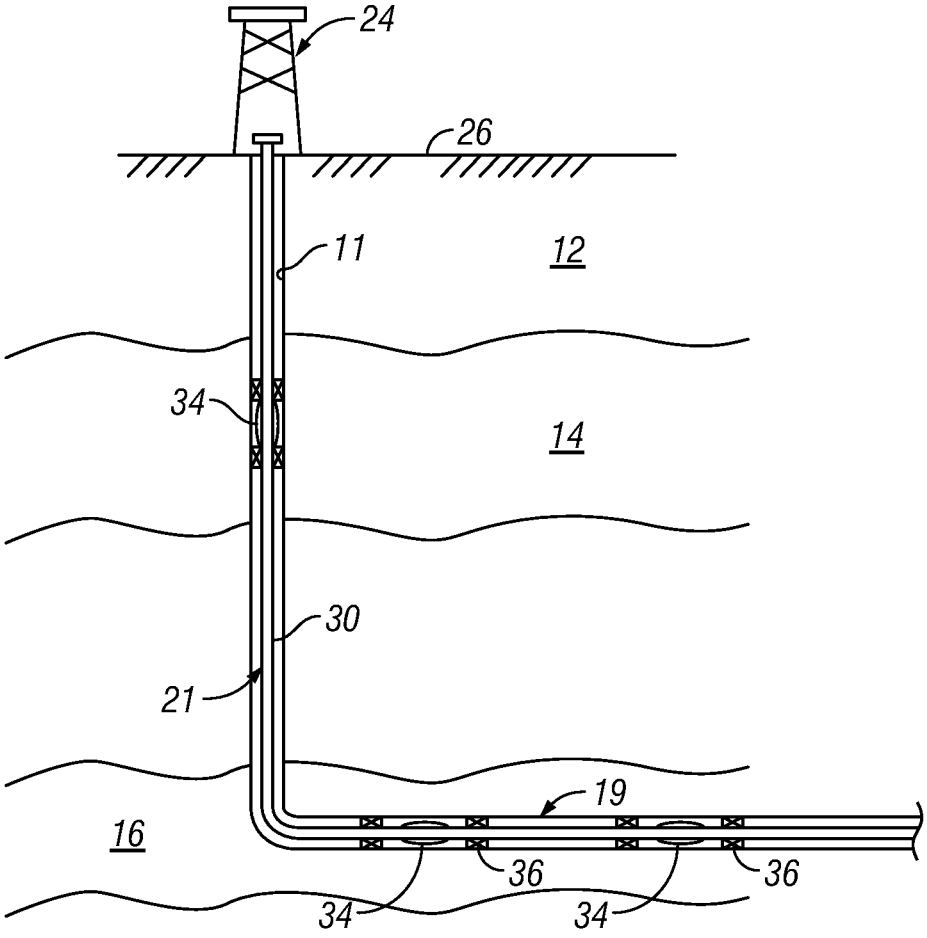
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 34. The nature of the production control device is such that the fluid flow is directed from the formation 16 directly to the nearest production device 34, hence resulting in a balanced flow. In some instances, packers may be omitted from the open hole completion.

Figure 3:
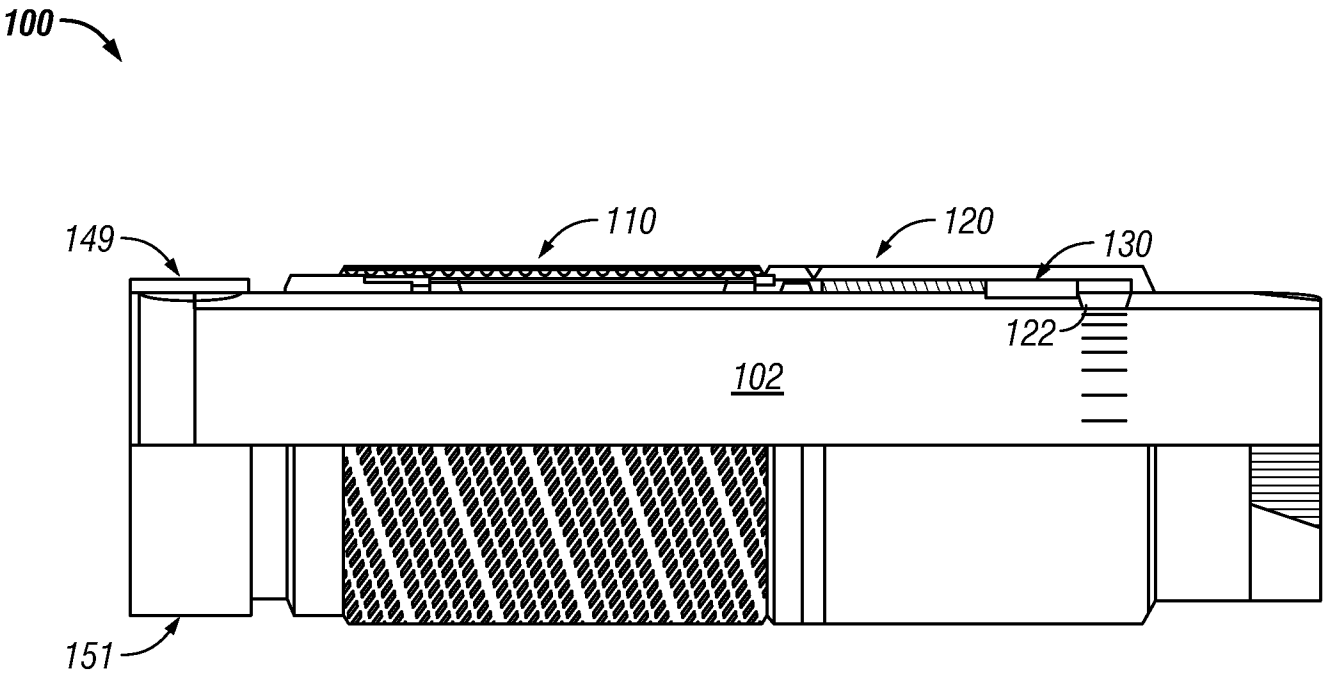
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a production string via one or more passages 122. This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids, an in-flow control device 120 that controls overall drainage rate from the formation, and a flow control device 130 that controls in-flow area based upon the composition of a fluid in the vicinity of the flow control device 130. The particulate control device 110 can include known devices such as sand screens and associated gravel packs and the in-flow control device 120 can utilize devices employing tortuous fluid paths designed to control inflow rate by creating pressure drops. Exemplary flow control devices are discussed below.

Figure 4:
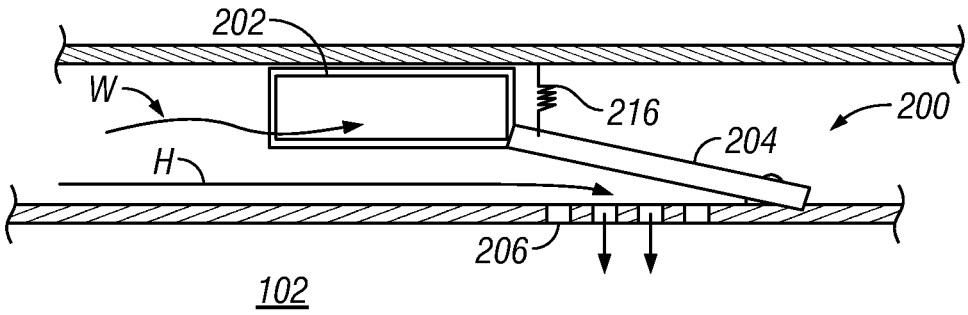
FIG. 4 is a schematic view of a flow control device made in accordance with one embodiment of the present disclosure that utilizes a body having controllable buoyancy in connection with a flapper.
Figure 8:
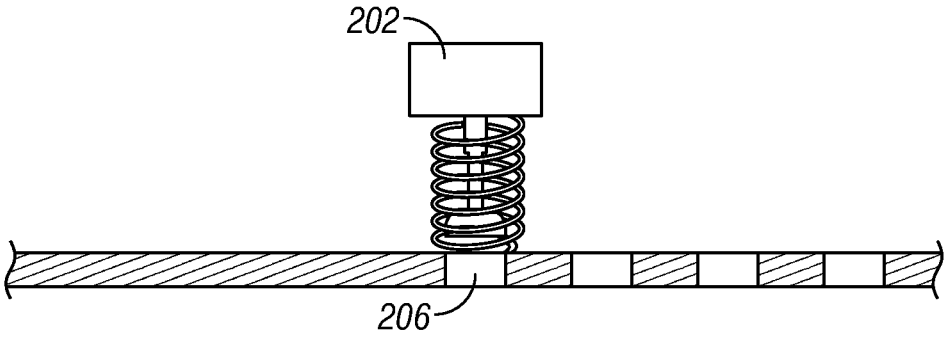
FIG. 8 is a schematic view of a flow control device made in accordance with one embodiment of the present disclosure that utilizes a body having controllable buoyancy in connection with a poppet valve.

Referring now to FIG. 4, in one configuration, the flow control device 200 may be positioned along the production control device 100 (FIG. 3) and configured to control fluid flow into the flow bore 102 based upon one or more characteristics (e.g., water content) of the in-flowing fluid. The flow control device 200 may include a body 202 that is configured to increases in weight when water W is present in the flow control device 130 (FIG. 3). The increased weight actuates a flow restriction element 204 that is configured to partially or completely restrict flow through a passage 206. The passage 206, when open, may provide fluid communication between the formation and the flow bore 102 (FIG. 3). As shown, the flow restriction element 204 is a flapper valve. However, in variants, the flow restriction element may be a poppet valve, a sliding sleeve valve or any other device suitable for partially or completely blocking fluid flow across the passage 206. A poppet vale is shown in FIG. 8.

Figure 5:
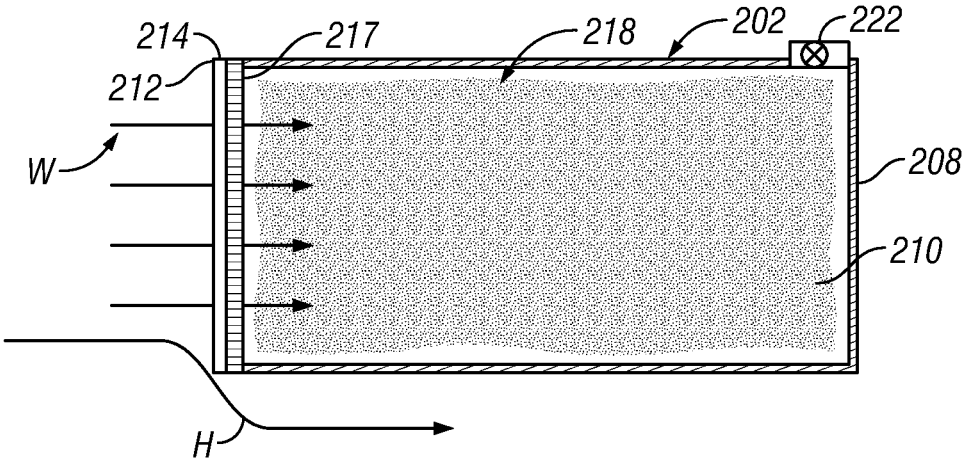
FIG. 5 is a schematic view of a body having controllable buoyancy in accordance with one embodiment of the present disclosure.

Referring now to FIGS. 4 and 5, the body 202 may include a shell or enclosure 208 forming an interior space or void 210. The enclosure 208 may be formed of a rigid material (e.g., metal, ceramic, composite) or a flexible material (e.g., plastic, rubber, etc.). An opening 212 may include a membrane 214 that control fluid communication between the void 210 and the exterior of the enclosure 208. The membrane 214 may be configured to allow water W to flow into the void 210 but block the entry of other fluids such as liquid hydrocarbons H. For example, the membrane 214 may be a semi-permeable membrane that separates water from dissolved solutes, mixtures, emulsions and the like. An osmotic pressure gradient may be used to induce a net flow of water through the membrane. In another arrangement, a reverse osmosis process may be used wherein differential hydraulic pressure is used as the driving force for separation. It should be understood that the term "water" may refer to water as well as fluids that include water, such as brines. In embodiments, the membrane 214 may be supported by a rigid filter element 217. The void 210 may be a vacuum, a partial vacuum, or include a gas.

As shown, the void 210 may also includes a permeable material 218. The permeable material 218 may be any material formed to receive, store, and/or convey fluids and may include, but not be limited to, open-cell foams, reticulated metal foams, shaped sintered powder and capillary tubes. The permeable material 218 may be configured to provide structural support for the enclosure 208, membrane 214, filter element 217, etc., and/or to provide a capillary effect to assist in drawing water into or throughout the enclosure 208. In certain embodiments, the enclosure 208 may be formed of a flexible material that is wrapped around a relatively rigid open-cell material 218. Such an enclosure 208 may be formed partially or completely of a membrane configured to allow a flow of water into the relatively rigid open-cell material 218.

Initially, the void 210 may be at least partially empty. Optionally, a one way check valve 222 may be used to allow gas to escape the body 202 as the void 210 fills with water W. Thus, initially, the body 202 may be buoyant in the surrounding in-flowing fluid. In one arrangement, the body 202 is connected to one end of the flow restriction element 204. In other arrangements, the body 202 may be connected to a lever or other suitable mechanism that can shift the flow restriction element 204 between an open and closed position in response to the movement or motion of the body 202. Optionally, an opening force may be used to keep the flow restriction element 204 in an opening position. As shown, the opening force may be applied by a spring element 216. Other devices for generating an opening force include hydraulic pressure, pneumatic pressure, a magnetic field, etc.

During fluid flow with little or no water cut, the membrane 214 prevents hydrocarbons H from entering the enclosure 208. Thus, the body 202 may float in the in-flowing fluid and the flow restriction element 204 is maintained in an open position. When the body 202 is exposed to a sufficient amount of water W, the membrane 214 permits water W to enter into the void 210. If present, the valve 222 permits gases in the void 210 to escape. As the void 210 gradually fills with water W, the body 202 loses its buoyancy. The body 202 sinks due to gravity and applies a closing force on the flow restriction element 204. Once the closing force is of a sufficient magnitude to overcome the opening force of the biasing element 216, (if present), the flow restriction element 204 moves into sealing engagement with the passage 206.

Thus, in aspects, embodiments of the present disclosure may include flow control devices that utilize bodies that are selectively buoyant. The flow control device may be used to directly shift a flow restriction element from a open position to a closed position. The flow control devices may be positioned on a wellbore high side and sink in a surrounding fluid when exposed to water. The sinking of the flow control device actuates a flow restriction element to a closed position.

Figure 6:
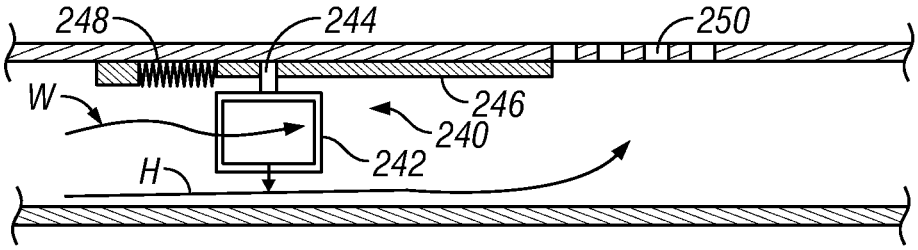
FIG. 6 is a schematic view of a flow control device made in accordance with one embodiment of the present disclosure that utilizes a body having controllable buoyancy in connection with a sliding sleeve valve.

Referring now to FIG. 6, there is shown another embodiment of a flow control device 240 that utilizes controllable buoyancy to actuate a flow restriction element. In this embodiment, a body 242 formed in the same manner as that shown in FIG. 5 is connected to a trip or trigger element 244. The trigger element 244 restrains movement of an actuating sleeve 246. A compressed biasing element such as a spring 248 applies a closing force that urges the sliding sleeve 246 from an open position to a closed position. As before, the body 242 is buoyant and applies an upward force that keeps the trigger element 244 connected to the sleeve 246. As water enters the body 242, the body 242 loses buoyancy. Once the body 242 is sufficiently heavy, the body 242 drops or sinks and pulls the trigger element 244 out of engagement with the sleeve 246. The released body sleeve 246 is urged by the spring 248 into a closed position wherein flow across the passages 250 is blocked.

Thus, in aspects, embodiments of the present disclosure may include flow control devices that have selectively controllable buoyancy that may be in connection with a separate actuator that shifts a flow restriction element from an open position to a closed position. The flow control devices may be positioned on a wellbore low side and the selectively buoyant body may sink in a surrounding fluid when exposed to water. The sinking of the flow control device actuates the separate actuator to shift the flow restriction element to the closed position.

Figure 7:
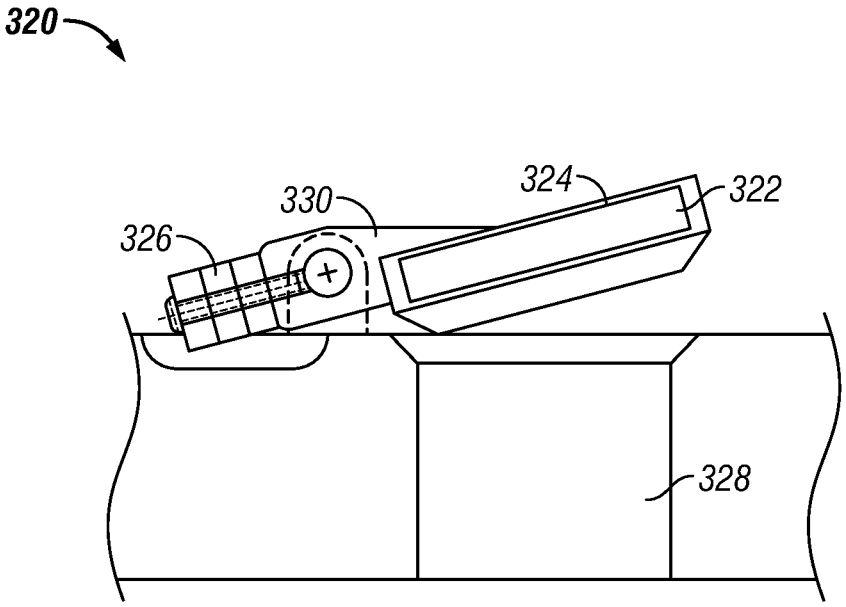
FIG. 7 is a schematic view of a flow control device made in accordance with one embodiment of the present disclosure that utilizes a controllably buoyant body integrated into a flow restriction element.

Referring now to FIG. 7, the flow control device 320 includes a selectively buoyant body 322 that is connected to a flow restriction element 324 that partially or completely restricts flow through an passage 328. As used herein, the terms controllably buoyant, selectively buoyant or adjustably buoyant encompass bodies or structures that may undergo a change in buoyancy in response to a stimulus (e.g., a change in fluid composition). Optionally, the flow control device 320 may include a counter weight 326 positioned on an end of a lever 330 connected to the flow restriction element 324. In this embodiment, selectively buoyant body 322 formed in the same manner as the body 202 as shown in FIG. 5. As before, the buoyant body 322 is initially buoyant and floats in the in-flowing fluid to maintain the flow restriction element 324 in an open position. When the buoyant body 322 is exposed to a sufficient amount of water, water enters the buoyant body 322. Eventually, the buoyant body 322 sinks due to gravity and pushes the flow restriction element 324 into a closed position. The counter weight 326 is of a sufficient magnitude to overcome the opening force of the biasing element, (if present), the flow restriction element 324 moves a sealing engagement with the passage 328. It should be appreciated that the buoyant body 322 may be incorporated or integrated into the body of the flow restriction element 320.

In some embodiments, the selectively buoyant body may be configured to react with an engineered fluid, such as drilling mud, or fluids introduced from the surface such as brine. Thus, in addition to a change in composition of the fluid flowing from the formation, the flow control devices can be activated as needed from the surface. Also, such fluid may be used to evacuate the selectively buoyant body of water to reset the flow restriction element to an open position. Additionally, it should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow to those and other wellbore tubulars.

From the above, it should be appreciated that what has been described includes a method for producing fluid from a subterranean formation. In one arrangement, the method includes configuring a body to at least partially fill with a selected fluid; and actuating a flow restriction element using the body. The selected fluid may be water. In aspects, the method may include controlling an entry of fluid into the body using a membrane. In aspects, the membrane may be configured to block a flow of hydrocarbons into the body. In aspects, the method may also include venting a fluid from the body as the body fills with the selected fluid. In further aspects, the method may include controlling a flow of fluid into a passage in communication with a flow bore; and applying a force to the flow restriction element using the body as the body fills with the selected fluid. The force may urge the flow restriction element into a sealing engagement with the passage. The flow restriction element may include an open position wherein the flow restriction element is disengaged from the passage and a closed position wherein the flow restriction element at least partially blocks the passage. The flow bore may be a bore of a wellbore tubular. In aspects, the method may include maintaining the flow restriction element in the open position while the body is substantially not filled with water, and shifting the flow restriction element to the closed position after the body substantially fills with water.

It should be appreciated that what has been described also includes an apparatus for controlling flow of a fluid into a wellbore tubular. In one embodiment, the apparatus may include a selectively buoyant body configured to fill with a selected fluid, and a flow restriction element responsive to a movement of the selectively buoyant body. In aspects, the selectively buoyant body includes a membrane configured to block a flow of hydrocarbons into the selectively buoyant body. The selected fluid may include water. The selectively buoyant body may be coupled to the flow restriction element. In aspects, the flow restriction element may include, but not be limited to, a flapper, a sliding sleeve, and a poppet valve. In aspects, the interior of the body may be at least partially filled with a permeable material, which includes, but is not limited to, open-cell foam, reticulated metal foam, shaped sintered powder and capillary tubes.

It should be appreciated that what has been described also includes a system for controlling a flow of a fluid in a well intersecting a formation of interest. The system may include a tubular configured to be disposed in the well; a flow restriction element positioned at a selected location along the tubular, the flow restriction element being configured to control flow between a bore of the tubular and the exterior of the tubular; and an actuator coupled to the flow restriction element. The actuator may include a selectively buoyant body that has an interior space and a membrane controlling fluid communication into the interior space. In aspects, a valve may be used to vent the interior space. In embodiments, the system may include a plurality of flow restriction elements positioned at selected locations along the tubular. Each flow restriction element may be configured to control flow between a bore of the tubular and the exterior of the tubular. An actuator coupled to each flow restriction element may include a selectively buoyant body having an interior space and a membrane controlling fluid communication into the interior space.

For the sake of clarity and brevity, descriptions of most threaded connections between tubular elements, elastomeric seals, such as o-rings, and other well-understood techniques are omitted in the above description. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. A method for producing a fluid mixture from a subterranean formation, the fluid mixture having at least a first fluid and a different second fluid, the method comprising:

placing a body in the fluid mixture flowing between the subterranean formation and a flow bore of a wellbore tubular, the body having a cavity at least partially filling with the first selected fluid, the body having a membrane blocking entry of the second selected liquid into the body; and actuating a flow restriction element as the body sinks in a surrounding fluid.

2. The method according to claim 1 wherein the first selected fluid is water.

3. The method according to claim 1 further comprising configuring the body to be buoyant in the surrounding fluid when the first selected fluid is not in the body.

4. The method according to claim 1 wherein the membrane blocks a flow of hydrocarbons into the body.

5. The method according to claim 1 further comprising venting a fluid from the body as the body fills with the first selected fluid.

6. The method according to claim 1 further comprising:

controlling a flow of fluid into a passage in communication with a flow bore using a flow restriction element; and applying a force to the flow restriction element using the body as the body sinks in the surrounding fluid, wherein the force urges the flow restriction element into a sealing engagement with the passage.

7. The method according to claim 6 wherein the flow restriction element has an open position wherein the flow restriction element is disengaged from the passage and a closed position wherein the flow restriction element at least partially blocks the passage; and wherein the body is a shell.

8. The method according to claim 7 wherein the flow bore is a bore of a wellbore tubular; and further comprising maintaining the flow restriction element in the open position while the body is substantially not filled with water, and shifting the flow restriction element to the closed position after the body substantially fills with water.

9. The method according to claim 1 further comprising at least partially filling the body with a permeable material configured to store the first selected fluid.

10. An apparatus for controlling flow of a fluid into a wellbore, comprising:

a body in a fluid mixture, the body being configured to fill with a first selected fluid from the fluid mixture and block a flow of a second selected liquid from the fluid mixture into the body, wherein the body includes a membrane configured to block a flow of the first selected liquid into the body; and a flow restriction element responsive to a movement of the body, wherein the body is configured to sink in a surrounding fluid as the first selected fluid fills the body.

11. The apparatus according to claim 10 wherein the first selected fluid is water.

12. The apparatus according to claim 11 wherein a selectively buoyant body is coupled to the flow restriction element.

13. The apparatus according to claim 12 wherein the body is configured to be buoyant in the surrounding fluid when the first selected fluid is not in the body and the flow restriction element is selected from the group consisting of: (i) a flapper, (ii) a sliding sleeve, and (iii) a poppet valve.

14. A system for controlling a flow of a fluid in a well intersecting a formation of interest, comprising:

a tubular configured to be disposed in the well;

a flow restriction element positioned at a selected location along the tubular, the flow restriction element being configured to control flow between a bore of the tubular and the exterior of the tubular; and an actuator coupled to the flow restriction element, the actuator including a body having an interior space and a membrane controlling fluid communication into the interior space, the membrane allowing a flow of water into the interior space while blocking a flow of a hydrocarbon into the interior space.

15. The system according to claim 14 wherein the membrane is configured to be semi-permeable to allow water to flow through the membrane.

16. The system according to claim 15 wherein the membrane is further configured to use an osmotic pressure gradient.

17. The system according to claim 14 further comprising a plurality of flow restriction elements positioned at selected locations along the tubular, each flow restriction element being configured to control flow between a bore of the tubular and the exterior of the tubular; and an actuator coupled to each flow restriction element, each actuator including a body having an interior space and a membrane controlling fluid communication into the interior space.

18. The system according to claim 14 comprising at least partially filling the body with a permeable material.

19. The system according to claim 18 wherein the permeable material includes one of: (i) open-cell foam, (ii) reticulated metal foam, (iii) shaped sintered powder, and (iv) capillary tube.

* * * * *